US010401031B2

(12) United States Patent
Hirata et al.

(10) Patent No.: US 10,401,031 B2
(45) Date of Patent: Sep. 3, 2019

(54) GAS TURBINE COMBUSTOR

(71) Applicant: MITSUBISHI HITACHI POWER SYSTEMS, LTD., Yokohama (JP)

(72) Inventors: Yoshitaka Hirata, Yokohama (JP); Tatsuya Sekiguchi, Yokohama (JP); Tomoki Uruno, Yokohama (JP); Akinori Hayashi, Yokohama (JP); Hirokazu Takahashi, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 404 days.

(21) Appl. No.: 14/807,071

(22) Filed: Jul. 23, 2015

(65) Prior Publication Data

US 2016/0025346 A1 Jan. 28, 2016

(30) Foreign Application Priority Data

Jul. 24, 2014 (JP) ..... 2014-151101

(51) Int. Cl.
*F23R 3/48* (2006.01)
*F23R 3/36* (2006.01)
(Continued)

(52) U.S. Cl.
CPC ..... *F23R 3/48* (2013.01); *F23R 3/286* (2013.01); *F23R 3/36* (2013.01); *F23R 3/04* (2013.01);
(Continued)

(58) Field of Classification Search
CPC .... F23R 3/286; F23R 3/36; F23R 3/48; F23R 3/28; F23R 3/04
See application file for complete search history.

(56) References Cited

U.S. PATENT DOCUMENTS 2,540,642 A * 2/1951 Allen ..... F02C 7/264 60/39.37
2,543,366 A * 2/1951 Haworth ..... F02C 7/26 60/263
(Continued)

FOREIGN PATENT DOCUMENTS

CN 102384474 A 3/2012
CN 103225822 A 7/2013
(Continued)

OTHER PUBLICATIONS

Chinese Office Action received in corresponding Chinese Application No. 201510427605.3 dated Apr. 5, 2017.
(Continued)

*Primary Examiner* — Todd E Manahan
*Assistant Examiner* — Eric W Linderman
(74) *Attorney, Agent, or Firm* — Mattingly & Malur, PC

(57) ABSTRACT

A combustor is capable of ignition and flame propagation at low fuel concentrations for gas or liquid fuel. Combustors are disposed annularly along an outer peripheral portion of a casing of a turbine. A combustion chamber burns fuel and air to generate a combustion gas. A diffusion burner is disposed upstream of the combustion chamber; and a plurality of premix burners are disposed around the diffusion burner. Cross fire tubes provide communication between combustion chambers of combustors adjacent to each other. A cross fire tube connected to a combustor adjacent to a first side in the circumferential direction of the casing is disposed so as to have a central axis passing over a premix burner as viewed from the combustion chamber and another cross fire tube connected to the combustor adjacent to a second side is disposed so as to have a central axis passing between two premix burners.

5 Claims, 7 Drawing Sheets

(51) Int. Cl.
*F23R 3/28* (2006.01)
*F23R 3/04* (2006.01)

(52) U.S. Cl.
CPC ..... *F23R 3/28* (2013.01); *F23R 2900/03343* (2013.01)

(56) References Cited

U.S. PATENT DOCUMENTS 2,611,243 A * 9/1952 Huyton ..... F23R 3/48 60/39.37
2,619,162 A * 11/1952 Feilden ..... F02C 7/232 137/471
2,679,136 A * 5/1954 Gaubatz ..... F23R 3/48 60/39.37
2,722,803 A * 11/1955 Travers ..... F23R 3/48 60/39.37
2,729,938 A * 1/1956 McDowall ..... F23R 3/48 285/19
2,832,195 A * 4/1958 Weissborn, Jr. ..... F23R 3/48 285/302
2,958,196 A * 11/1960 Gatzemeyer ..... F02C 7/264 60/39.37
2,979,898 A * 4/1961 Ward ..... F23R 3/48 60/39.37
3,001,366 A * 9/1961 Shutts ..... F23R 3/48 285/223
3,032,990 A * 5/1962 Rogers ..... F02C 7/264 60/740
3,184,918 A * 5/1965 Mulcahey ..... F23R 3/48 60/39.37
3,344,601 A * 10/1967 Mieczkowski, Jr. ..... F23R 3/48 285/148.27
3,650,106 A * 3/1972 Guillot ..... F02C 7/22 60/39.37
3,721,089 A * 3/1973 Morrison ..... F23R 3/48 285/364
3,811,274 A * 5/1974 Calderon ..... F23R 3/48 60/39.37
3,991,560 A * 11/1976 DeCorso ..... F23R 3/48 60/39.37
4,249,372 A * 2/1981 White ..... F23R 3/48 60/39.37
5,154,049 A * 10/1992 Ford ..... F23R 3/48 60/39.37
5,219,256 A * 6/1993 Ford ..... F16B 21/186 411/517
5,265,413 A * 11/1993 Cannon ..... F23R 3/48 60/39.37
5,335,491 A * 8/1994 Barbier ..... F23R 3/34 60/39.37
5,603,531 A * 2/1997 Maier ..... F02K 1/80 285/145.1
5,964,250 A * 10/1999 Mueller ..... F23R 3/48 138/109
6,220,015 B1 * 4/2001 Mina ..... F23R 3/48 60/39.37
6,250,065 B1 * 6/2001 Mandai ..... F02C 7/232 60/39.094
6,334,294 B1 * 1/2002 Belsom ..... F23R 3/48 60/39.37
7,143,583 B2 * 12/2006 Hayashi ..... F23R 3/18 60/776
8,082,724 B2 * 12/2011 Hirata ..... F02C 3/14 60/39.094
9,115,899 B2 * 8/2015 Koizumi ..... F23R 3/286
9,650,961 B2 * 5/2017 Hirata ..... F02C 7/222
2001/0004827 A1 * 6/2001 Vandervort ..... F23R 3/14 60/39.55
2001/0027637 A1 * 10/2001 Norster ..... F23C 7/002 60/773
2003/0121269 A1 * 7/2003 Mick ..... F02C 3/22 60/779
2004/0000146 A1 * 1/2004 Inoue ..... F02C 7/22 60/776
2004/0035114 A1 * 2/2004 Hayashi ..... F23R 3/18 60/737
2004/0255589 A1 * 12/2004 Yoshida ..... F23R 3/286 60/746
2006/0127827 A1 * 6/2006 Yoshida ..... F23C 7/004 431/8
2008/0275619 A1 * 11/2008 Sasao ..... F23N 5/003 701/100
2009/0139241 A1 * 6/2009 Hirata ..... F02C 3/14 60/746
2009/0173057 A1 * 7/2009 Yoshida ..... F01D 15/10 60/39.281
2010/0251725 A1 * 10/2010 Dodo ..... F23R 3/286 60/772
2011/0094239 A1 * 4/2011 Koizumi ..... F23R 3/346 60/776
2011/0185703 A1 * 8/2011 Dodo ..... F23D 14/24 60/39.461
2012/0047897 A1 * 3/2012 Hirata ..... F23R 3/48 60/737
2012/0055161 A1 * 3/2012 Sekiguchi ..... F02C 9/28 60/737
2012/0131924 A1 * 5/2012 Yoshida ..... F23R 3/343 60/772
2012/0291446 A1 * 11/2012 Hirata ..... F23D 11/402 60/772
2013/0097991 A1 * 4/2013 Zhang ..... F23K 5/06 60/39.59
2013/0098041 A1 * 4/2013 Zhang ..... F23K 5/005 60/734
2013/0192245 A1 8/2013 Miura et al.
2013/0219900 A1 * 8/2013 Hirata ..... F02C 7/00 60/740
2014/0069079 A1 * 3/2014 Koizumi ..... F23R 3/12 60/39.463
2014/0083102 A1 * 3/2014 Miura ..... F23R 3/286 60/737
2014/0144144 A1 * 5/2014 Hirata ..... F23R 3/283 60/738
2015/0059353 A1 * 3/2015 Asai ..... F02C 3/22 60/778
2015/0082770 A1 * 3/2015 Igarashi ..... F23R 3/286 60/39.463
2015/0121879 A1 * 5/2015 Hirata ..... F23R 3/002 60/722
2015/0354823 A1 * 12/2015 Koizumi ..... F23R 3/286 60/737
2016/0040883 A1 * 2/2016 Asai ..... F23R 3/002 60/737
2016/0377290 A1 * 12/2016 Okazaki ..... F02C 3/145 60/752
2017/0138268 A1 * 5/2017 Nakahara ..... F02C 7/22
2017/0138598 A1 * 5/2017 Akiyama ..... F23R 3/28

FOREIGN PATENT DOCUMENTS

| | | |
|---|---|---|
| EP | 2 213 942 | 8/2010 |
| EP | 2 423 600 A2 | 2/2012 |
| EP | 2 620 708 A2 | 7/2013 |
| GB | 755861 A | 8/1956 |
| JP | 2009-052795 A | 3/2009 |
| JP | 2013-155946 A | 8/2013 |

OTHER PUBLICATIONS

Extended European Search Report received in corresponding European Application No. 15177793.5 dated Dec. 15, 2015.
Japanese Office Action received in corresponding Japanese Application No. 2014-151101 dated Oct. 3, 2017.

* cited by examiner

GAS TURBINE COMBUSTOR

BACKGROUND OF THE INVENTION

1. Field of the Invention

The present invention relates to a gas turbine combustor.

2. Description of the Related Art

A plurality of combustors included in gas turbines are generally disposed annularly along a circumferential direction of a turbine rotor, with adjacent combustors being spatially connected by a cross fire tube. In this type of gas turbine combustor, a combustor having an ignition plug is first ignited. A differential pressure generated between the combustor and an adjoining combustor that is yet to be ignited then causes combustion gas to flow from the ignited combustor to the adjoining combustor, thereby igniting combustors yet to be ignited one after another.

To reduce NOx emissions in the combustors incorporating the above-described ignition system, an increasing number of combustors employ a premix combustion system. One known arrangement for improving ignition performance in the combustors that employ the premix combustion system includes a diffusion burner disposed at the center of each of the combustors, a plurality of premix burners disposed around the diffusion burner, and cross fire tubes for connecting the respective combustors disposed between the premix burners (see, for example, JP-2009-52795-A).

SUMMARY OF THE INVENTION

A need exists in recent years for increasing the degree of freedom in selecting fuels as a measure against global warming. The further reduction in the NOx emissions has been required as well. For this reason, a combustor has been developed that responds to both gas fuel and liquid fuel and reduces the NOx emissions. The combustor introduces the gas fuel and the liquid fuel into the same combustor and selectively burns either one of the fuels (a dual-fuel firing, low NOx combustor).

This type of combustor generally increases a fuel concentration for greater energy during ignition, thereby improving ignition performance and flame propagation performance of the combustor. To achieve the greater ignition energy by increasing the fuel concentration can, however, shorten the service life of turbine blades due to a greater heat shock applied to the turbine blades. Additionally, the gas fuel and the liquid fuel may each have a unique ignition characteristic (e.g., ignitable concentration ratios of fuel to air) and a need thus exists for achieving favorable ignition performance regardless of whichever fuel is used.

The present invention has been made in view of the foregoing situation and it is an object of the present invention to provide a highly reliable combustor capable of ignition and flame propagation at low fuel concentrations regardless of whether gas fuel or liquid fuel is used.

To achieve the foregoing object, an aspect of the present invention provides a plurality of combustors disposed annularly along an outer peripheral portion of a casing of a turbine, each combustor including: a combustion chamber that burns fuel and air to thereby generate a combustion gas; a diffusion burner disposed upstream of the combustion chamber; a plurality of premix burners disposed around the diffusion burner; and a plurality of cross fire tubes, each providing communication between combustion chambers of combustors adjacent to each other in a circumferential direction of the casing. The cross fire tube connected to the combustor adjacent to a first side in the circumferential direction of the casing is disposed so as to have an axis passing over the premix burner as viewed from the combustion chamber. The cross fire tube connected to the combustor adjacent to a second side in the circumferential direction of the casing is disposed so as to have an axis passing between two premix burners adjacent to each other as viewed from the combustion chamber.

The present invention provides a highly reliable combustor capable of ignition and flame propagation at low fuel concentrations regardless of whether gas fuel or liquid fuel is used.

DESCRIPTION OF THE PREFERRED EMBODIMENTS

First Embodiment

Configuration

1. Gas Turbine Plant

Figure 2:
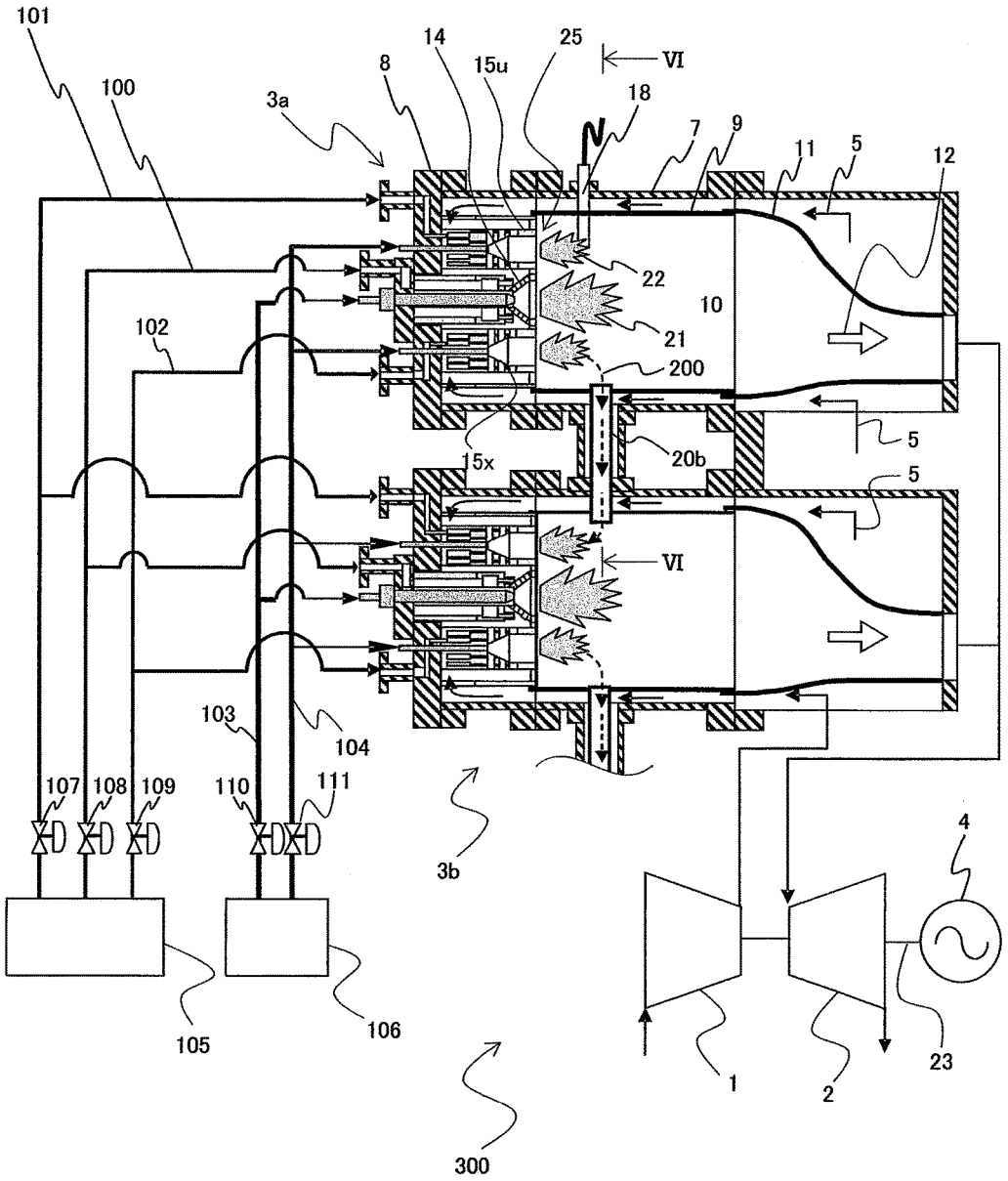
FIG. 2 is a configuration diagram showing an exemplary gas turbine plant to which the combustors according to the first embodiment of the present invention are applied.
Figure 3:
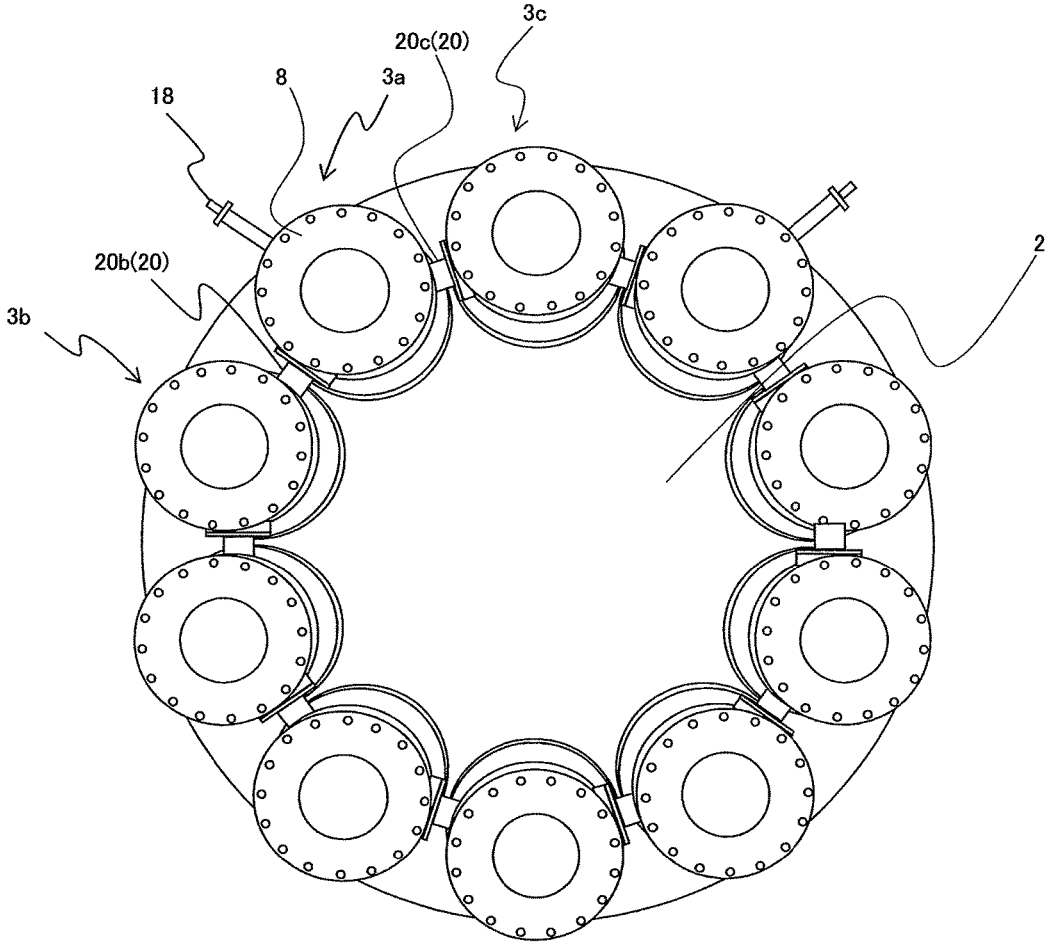
FIG. 3 is a diagram showing the combustors according to the first embodiment of the present invention as viewed from an upstream side.

FIG. 2 is a configuration diagram showing an exemplary gas turbine plant to which gas turbine combustors (hereinafter referred to as combustors) according to a first embodiment of the present invention are applied. FIG. 3 is a diagram showing the combustors according to the first embodiment of the present invention as viewed from an upstream side. As shown in FIG. 2, a gas turbine plant 300 includes a compressor 1, a turbine 2, combustors (3*a*, 3*b* . . . ), and a generator 4. It is noted that, although the first embodiment of the present invention includes, as shown in FIG. 3, ten combustors (3*a*, 3*b* . . . ) disposed annularly along an outer circumferential portion of a casing of the turbine 2, FIG. 2 shows the combustors 3*a* and 3*b* only.

The compressor 1 compresses air drawn in through an intake portion (not shown) to generate high-pressure compressed air 5 and supplies the combustors (3*a*, 3*b* . . . ) with the compressed air 5. The combustors 3*a* and 3*b* each mix the compressed air 5 supplied from the compressor 1 with fuel supplied from fuel systems 100, 101, 102, 103, and 104 (to be described later) and burns a resultant mixture. The combustors 3*a* and 3*b* each thereby generate a high-temperature combustion gas 12 and supplies the combustion gas 12 to the turbine 2. The turbine 2 is driven through expansion of the combustion gas 12 supplied from the combustors (3*a*, 3*b* . . . ). The generator 4 is rotated by a driving force obtained in the turbine 2 to generate electric power. In the first embodiment, the compressor 1, the turbine 2, and the generator 4 are connected to each other through a shaft 23.

2. Combustor

In the first embodiment, the ten combustors (3*a*, 3*b* . . . ) have an identical structure and the following describes the combustor 3*a*.

Figure 1:
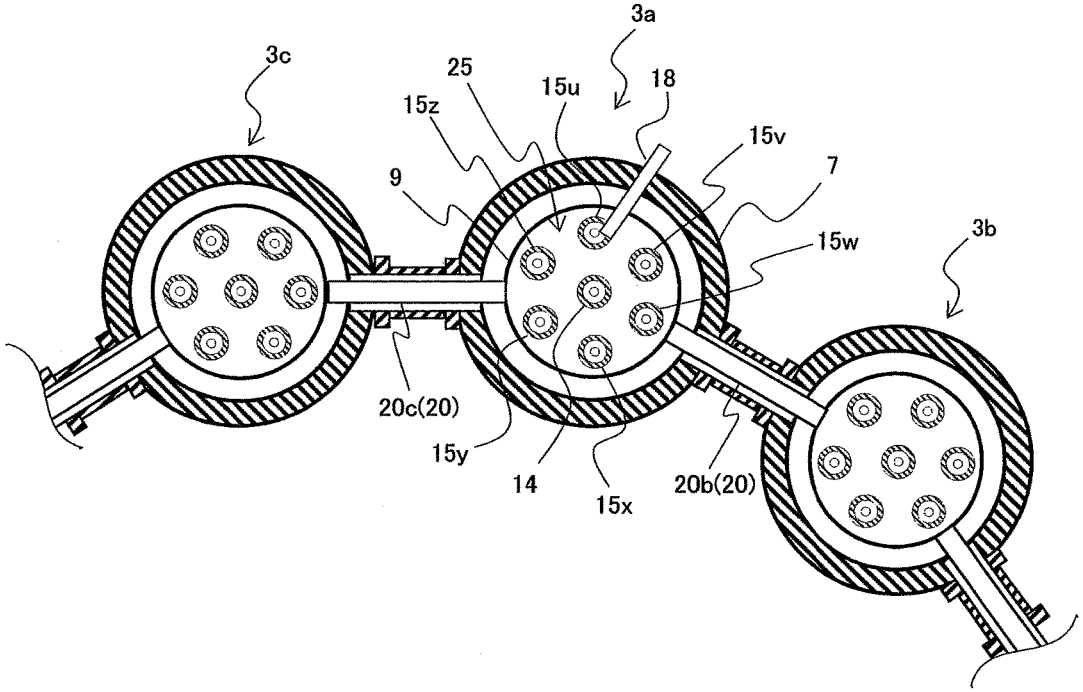
FIG. 1 is a diagram showing combustors according to a first embodiment of the present invention as viewed from a combustion chamber side.

The combustor 3*a* includes an outer casing 7, an end cover 8, an inner casing 9, a transition piece 11, a burner 25, and cross fire tubes 20*b* and 20*c* (see FIGS. 1 and 3). The inner casing 9 is disposed downstream of the burner 25 in a flow direction of the combustion gas 12. The inner casing 9 is formed into a cylinder, separating the compressed air 5 supplied from the compressor 1 from the combustion gas 12 generated by the combustor 3*a*. The outer casing 7 is disposed on an outer peripheral side of the inner casing 9. The outer casing 7 is formed into a cylinder, housing therein the inner casing 9, the burner 25, and the like. An annular space formed between the outer casing 7 and the inner casing 9 constitutes a flow path through which the compressed air 5 supplied from the compressor 1 to the combustor 3*a* flows. The end cover 8 is disposed upstream of the burner 25 in the flow direction of the combustion gas 12. The end cover 8 closes one end of the outer casing 7. A combustion chamber 10 is formed on the inside of the inner casing 9. A mixture of the compressed air 5 supplied from the compressor 1 and the fuel supplied from the fuel systems 100 to 103 is burned and the combustion gas 12 is consequently generated inside the combustion chamber 10. The transition piece 11 functions as a guide for directing the combustion gas 12 generated in the combustion chamber 10 toward the turbine 2. The transition piece 11 has a first end into which a downstream side of the inner casing 9 in the flow direction of the combustion gas 12 is inserted and a second end communicating with a line that couples the combustor 3*a* to the turbine 2.

3. Burner

FIG. 1 is a diagram showing the combustors (3*a*, 3*b* . . . ) according to the first embodiment of the present invention as viewed from the combustion chamber side. As shown in FIG. 1, the burner 25 includes a diffusion burner 14 and a plurality of (six in the first embodiment) premix burners 15. The diffusion burner 14 is disposed upstream of the combustion chamber 10 and coaxially with a central axis of the inner casing 9. The premix burners 15 are disposed around the diffusion burner 14. In the following description, the premix burners 15 are denoted as premix burners 15*u*, 15*v*, 15*w*, 15*x*, 15*y*, and 15*z* in the clockwise sequence, with the premix burner (that shown on the upper side of the diffusion burner 14 in FIG. 1) having an ignition plug 18 (to be described later).

The combustor having the diffusion burner and the premix burner, in general, includes a plurality of fuel systems in order to respond to widely ranging operating conditions and the number of burners to be burned is controlled in accordance with an operating load. In the first embodiment, as in FIG. 2, as gas fuel systems, a diffusion system 100 is connected to the diffusion burner 14, a premix system 101 is connected to the premix burners 15*u*, 15*w*, and 15*y* out of the six premix burners 15*u* to 15*z*, and a premix system 102 is connected to the premix burners 15*v*, 15*x*, and 15*z* out of the six premix burners 15*u* to 15*z* (the premix burners 15*v*, 15*w*, 15*y*, and 15*z* are not shown in FIG. 2). As liquid fuel systems, a diffusion system 103 is connected to the diffusion burner 14, a premix system 104 is connected to the six premix burner 15. The diffusion system 100 and the premix systems 101 and 102 serving as the gas fuel systems are connected to a gas fuel supply unit 105 that includes a fuel tank and a vaporizer and supply the gas fuel to the respective burners. The diffusion system 103 and the premix system 104 as the liquid fuel systems are connected to a liquid fuel supply unit 106 that includes a fuel tank and a booster and supply the liquid fuel to the respective burners.

The diffusion system 100 includes a gas fuel flow control valve 108 that regulates a flow rate of the gas fuel supplied to the diffusion burner 14. The premix systems 101 and 102 include gas fuel flow control valves 107 and 109, respectively, for regulating the flow rate of the gas fuel supplied to the premix burners 15*u*, 15*w*, and 15*y* and the premix burners 15*v*, 15*x*, and 15*z*, respectively.

The diffusion system 103 includes a liquid fuel flow control valve 110 that regulates the flow rate of the liquid fuel supplied to the diffusion burner 14. The premix system 104 includes a liquid fuel flow control valve 111 that regulates the flow rate of the liquid fuel supplied to the premix burners 15*u* to 15*z*.

As shown in FIG. 1, the combustor 3*a* includes the ignition plug 18. The position at which to dispose the ignition plug 18 is not specified. In the first embodiment, however, the ignition plug 18 is disposed such that a leading end of the ignition plug 18 is positioned near an outlet of the premix burner 15*u* as viewed from the combustion chamber 10. While FIG. 1 exemplifies that only the combustor 3*a* has one ignition plug 18, two out of the ten combustors (3*a*, 3*b* . . . ) may each have one ignition plug 18 as shown in FIG. 3. Alternatively, one out of the ten combustors (3*a*, 3*b* . . . ) may have two ignition plugs 18.

4. Cross Fire Tube

As shown in FIG. 3, the cross fire tube 20*b* connects the combustor 3*a* to the combustor 3*b* and the cross fire tube 20*c* connects the combustor 3*a* to the combustor 3*c*. Combustion chambers of two adjoining combustors out of the combustors (3*a*, 3*b* . . . ) spatially communicate with each other through a shared cross fire tube 20. The following describes the cross fire tubes 20*b* and 20*c*.

Figure 6:
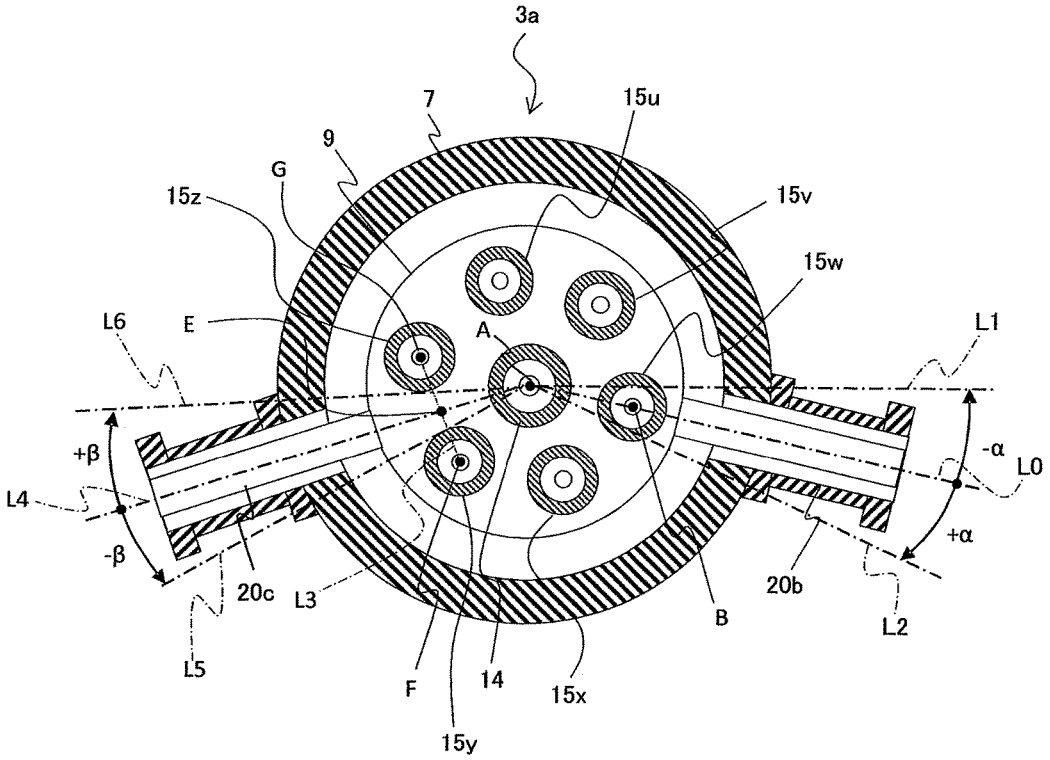
FIG. 6 is a cross-sectional view taken along line VI-VI in FIG. 2.

FIG. 6 is a cross-sectional view taken along line VI-VI in FIG. 2. FIG. 6 omits the ignition plug 18. As shown in FIG. 6, the cross fire tube 20*b* communicates with the combustion chamber of the combustor 3*b* adjacent to the combustor 3*a* on a first side in a circumferential direction of the casing of the turbine 2. The cross fire tube 20*b* is disposed so as to have an extension of a central axis passing over (or overlapping) the premix burner 15*w* (preferably the combustion chamber thereof) arranged on an inlet side of the cross fire tube 20*b* as viewed from the combustion chamber 10. The cross fire tube 20*c* communicates with the combustion chamber of the combustor 3*c* adjacent to the combustor 3*a* on a second side in the circumferential direction of the casing of the turbine 2. The cross fire tube 20*c* is disposed so as to have an extension of a central axis passing between the premix burner 15*y* and the premix burner 15*z* that are adjacent to each other and arranged on an inlet side of the cross fire tube 20*c* as viewed from the combustion chamber 10.

The following describes in detail arrangements of the cross fire tubes 20*b* and 20*c* and the premix burners 15*u* to 15*z*. In FIG. 6, let L0 be a straight line that passes through an axial center A of the combustor 3*a* and an axial center B of the premix burner 15*w*, and let L1 and L2 be two straight lines that pass through the axial center A of the combustor 3*a* and are tangent to an inner wall surface of the premix burner 15*w*. In this case, the cross fire tube 20*b* is disposed such that the central axis thereof is in a range between a position overlapping with the straight line L1 and a position overlapping with the straight line L2. In the first embodiment, with reference to a position at which an angle α formed by the central axis of the cross fire tube 20*b* and the straight line L0 is 0 degrees, specifically, a position at which the central axis of the cross fire tube 20*b* aligns with the straight line L0 (α=0 degrees), the angle α is, for example, ±15 degrees.

Let L3 be a line segment that connects an axial center F of the premix burner 15*y* and an axial center G of the premix burner 15*z*, L4 be a straight line that passes through the axial center A of the combustor 3*a* and a midpoint E of the line segment L3, and let L5 and L6 be two straight lines that pass through the axial center A of the combustor 3*a* and are respectively tangent to outer wall surfaces of the premix burners 15*y* and 15*z*. In this case, the cross fire tube 20*c* is disposed such that the central axis thereof is in a range between a position overlapping with the straight line L5 and a position overlapping with the straight line L6. In the first embodiment, with reference to a position at which an angle β formed by the central axis of the cross fire tube 20*c* and the straight line L4 is 0 degrees, specifically, a position at which the central axis of the cross fire tube 20*c* aligns with the straight line L4 (β=0 degrees), the angle β is, for example, ±15 degrees.

Operation

Figure 4:
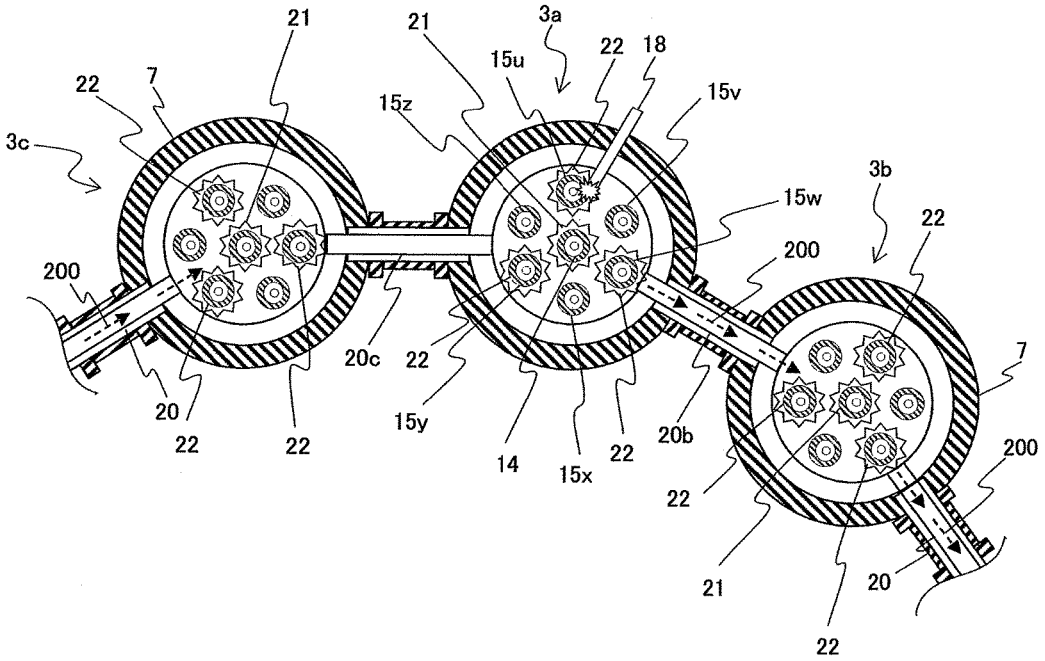
FIG. 4 is a diagram illustrating operations when the combustors are ignited using gas fuel.
Figure 5:
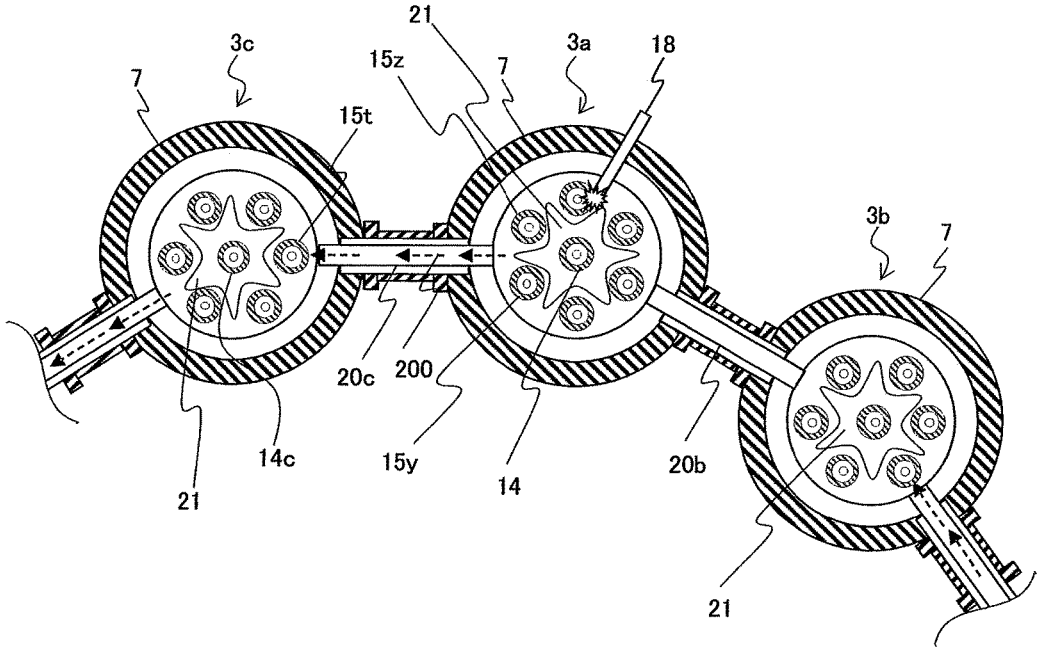
FIG. 5 is a diagram illustrating operations when the combustors are ignited using liquid fuel.

The following describes with reference to FIGS. 4 and 5 ignition operation of the combustor according to the first embodiment. FIG. 4 is a diagram illustrating operations when the combustors are ignited using the gas fuel. FIG. 5 is a diagram illustrating operations when the combustors are ignited using the liquid fuel.

Ignition Using Gas Fuel

In the first embodiment, as in FIG. 4, the gas fuel is supplied at ignition to the diffusion burner 14 in the combustor 3*a* and, out of the six premix burners 15*u* to 15*z*, three premix burners 15*u*, 15*w*, and 15*y* including the premix burner 15*w* disposed to face the inlet of the cross fire tube 20*b*. When the ignition plug 18 disposed at the combustor 3*a* is sparked under the foregoing condition, flames 21 and 22 are formed at positions near the outlets of the diffusion burner 14 and the three premix burners 15*u*, 15*w*, and 15*y*. The combustion gas 12 is consequently generated (see FIG. 2), which ignites the combustor 3*a*. When the combustor 3*a* is ignited, a differential pressure is generated between the combustor 3*a* and the combustors 3*b* and 3*c* that are yet to be ignited. At this time, the premix burner 15*w* is disposed closer to the cross fire tube 20*b* than any other premix burners 15 (no other burners are present between the premix burner 15*w* and the cross fire tube 20*b*) and, additionally, the cross fire tube 20*b* is disposed so as to have the extension of its central axis passing over the premix burner 15*w* as viewed from the combustion chamber 10. As a result, the flame 22 formed near the outlet of the premix burner 15*w* propagates along the cross fire tube 20*b* toward the combustor 3*b* so that a combustion gas 200 generated by the flame 22 tends to flow toward the combustor 3*b*. When the combustion gas 200 flows into the cross fire tube 20*b*, its resultant thermal energy burns a mixture jetted out from the premix burners and the diffusion burner of the combustor 3*b* to thereby form a flame, thus igniting the combustor 3*b*. The combustors yet to be ignited are thereafter ignited in sequence through similar operations till all the combustors are ignited.

Ignition Using Liquid Fuel

In the first embodiment, as in FIG. 5, the liquid fuel is supplied at ignition to only the diffusion burner 14. As with the gas fuel, preferably the liquid fuel is supplied to the premix burner in addition to the diffusion burner. The liquid fuel supplied to a plurality of fuel nozzles in a distributed manner, however, can lead to a reduced fuel supply pressure to aggravate an atomization characteristic of the liquid fuel such that the ignition performance can be impaired as well. To prevent this situation, only the diffusion burner 14 is supplied with the liquid fuel in the first embodiment. When the ignition plug 18 disposed at the combustor 3*a* is sparked under the foregoing condition, the flame 21 is formed at a position near the outlet of the diffusion burner 14. The combustion gas 12 is consequently generated (see FIG. 2), which ignites the combustor 3*a*. When the combustor 3*a* is ignited, a differential pressure is generated between the combustor 3*a* and the combustors 3*b* and 3*c* that are yet to be ignited. At this time, air is jetted out from the premix burners 15*u* to 15*z*. The cross fire tube 20*c* is, however, disposed so as to have the extension of its central axis passing between the premix burner 15*y* and the premix burner 15*z* that are adjacent to each other and arranged on the inlet side of the cross fire tube 20*c* as viewed from the combustion chamber 10, thereby, on top of that, no other burners are present between the diffusion burner 14 and the cross fire tube 20*c* along the central axis of the cross fire tube 20*c*. As a result, the flame 21 formed near the outlet of the diffusion burner 14 propagates along the cross fire tube 20*c* toward the combustor 3*c* so that the combustion gas 200 generated by the flame 21 tends to flow toward the combustor 3*c*. When the combustion gas 200 flows into the cross fire tube 20*c*, its resultant thermal energy burns a mixture jetted out from a diffusion burner 14*c* of the combustor 3*c* to thereby form a flame, thus igniting the combustor 3*c*. The combustors yet to be ignited are thereafter ignited in sequence through similar operations such that all the combustors are ignited.

It is noted that the combustor 3*c* includes a premix burner 15*t* disposed at a position near the outlet of the cross fire tube 20*c*. Air jetted out from the premix burner 15*t* is thus likely to inhibit the combustion gas 200 from igniting the mixture jetted out from the diffusion burner 14*c*. The liquid fuel forming part of the mixture, however, has a specific gravity greater than that of the air, and kinetic energy droplets of the liquid fuel have is sufficiently greater than that of the air. The liquid fuel supplied from the diffusion burner 14*c* thus can reach a point near the outlet of the cross fire tube 20*c* so that the ignition performance is not degraded compared to that when the gas fuel is used.

Effects

(1) Improvement of Ignition Characteristic

The combustor 3*a* in the first embodiment includes the cross fire tube 20*b* that is connected to the combustor 3*b* adjacent to the combustor 3*a* and that has the central axis passing over the premix burner 15*w* of the combustor 3*a* as viewed from the combustion chamber 10. For this reason, when the gas fuel is used, the supply of the fuel to the premix burner 15*w* causes the flame 22 formed near the outlet of the premix burner 15*w* to readily propagate to reach the combustor 3*b*, thus promoting the inflow of the combustion gas 200 into the combustor 3*b*, as described earlier. Moreover, because the mixture can be jetted out to a point near the outlet of the cross fire tube 20*b* in the combustor 3*b*, the combustor 3*b* is easily ignited by the combustion gas 200 that flows into the combustor 3*b* via the cross fire tube 20*b*. The ignition performance of the combustor is thus improved.

Additionally, the combustor 3*a* in the first embodiment includes the cross fire tube 20*c* that is connected to the combustor 3*c* adjacent to the combustor 3*a* and that has the central axis passing between the premix burner 15*y* and the premix burner 15*z* that are adjacent to each other as viewed from the combustion chamber 10. When the liquid fuel is used, for example, supplying the fuel to only the diffusion burner 14 causes the flame 21 formed near the outlet of the diffusion burner 14 to readily propagate to reach the combustor 3*c*, thereby promoting the inflow of the combustion gas 200 into the combustor 3*c*.

Through the foregoing effects, the combustors (3*a*, 3*b* . . . ) according to the first embodiment achieve improved ignition performance regardless of whether either the gas fuel or the liquid fuel is used or both the gas fuel and the liquid fuel are used and achieve greater reliability because of their capability of ignition and flame propagation with low fuel concentrations. On top of that, the improved ignition performance allows the fuel concentration to be reduced so that the heat shock applied to the turbine blades is reduced for an extended service life of the blades.

(2) Greater Degree of Freedom in Design

In the combustor 3*a* according to the first embodiment, the cross fire tube 20*b* does not necessarily have to be disposed to have its central axis overlapping the straight line L0 and the cross fire tube 20*c* does not necessarily have to be disposed to have its central axis passing through the midpoint of the line segment L3. The cross fire tube 20*b* is only required to be disposed such that the central axis thereof is positioned in a range between the position overlapping with the straight line L1 and the position overlapping with the straight line L2. The cross fire tube 20*c* is only required to be disposed such that the central axis thereof is positioned in a range between the position overlapping with the straight line L5 and the position overlapping with the straight line L6. Even with the cross fire tube 20*b* and the cross fire tube 20*c* disposed in the foregoing manner, the combustion gas still effectively flows into the combustors 3*b* and 3*c* regardless of whether either the gas fuel or the liquid fuel is used or both the gas fuel and the liquid fuel are used. A sufficient degree of freedom in design is thus achieved while offering flexibility with respect to, for example, variations in the number of combustors and the number of premix burners.

Second Embodiment

Figure 7:
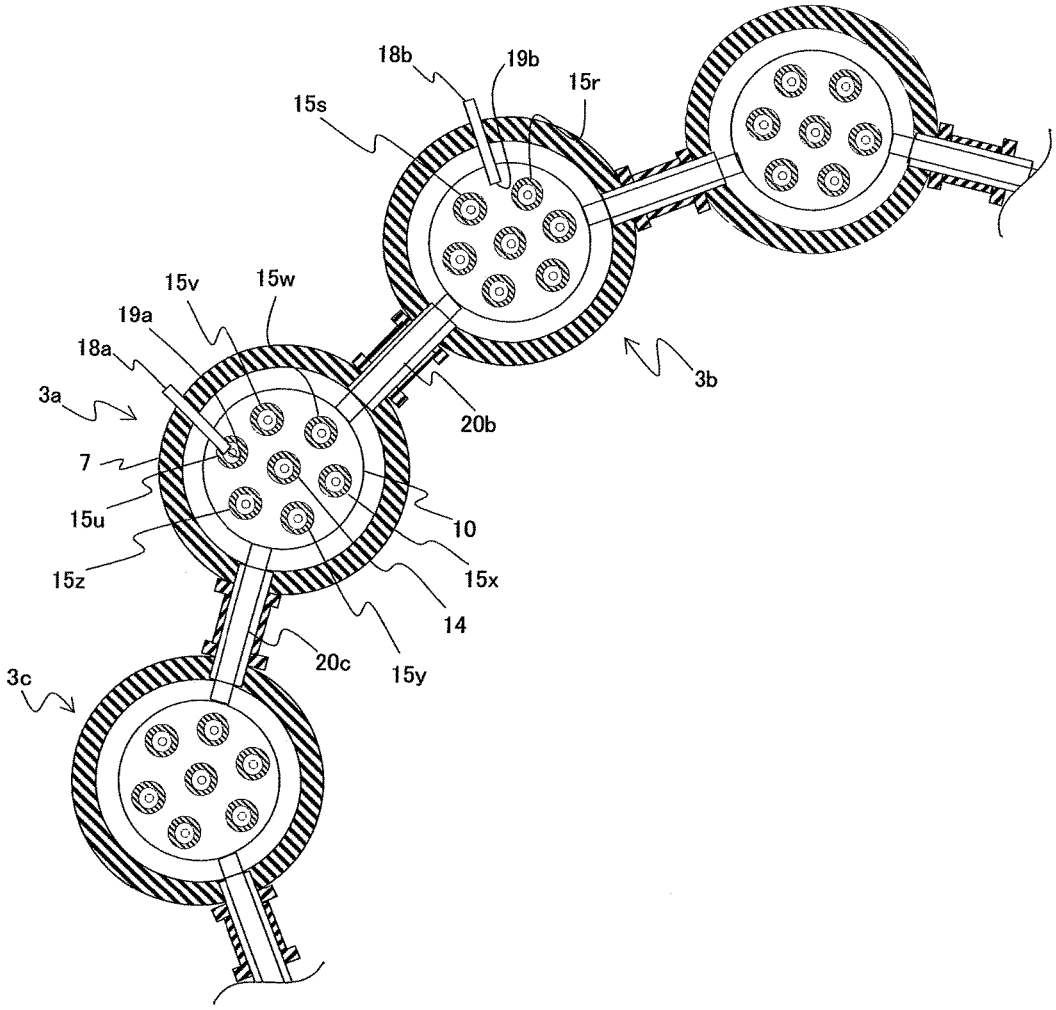
FIG. 7 is a diagram showing combustors according to a second embodiment of the present invention as viewed from a combustion chamber side.

FIG. 7 is a diagram showing combustors according to a second embodiment of the present invention as viewed from a combustion chamber side. As shown in FIG. 7, in the second embodiment, a combustor 3*a* includes an ignition plug (a first ignition plug) 18*a* and a combustor 3*b* includes an ignition plug (a second ignition plug) 18*b*.

The ignition plug 18*a* is disposed to have a leading end 19*a* positioned on a premix burner 15*u* as viewed from a combustion chamber 10. The ignition plug 18*b* is disposed to have a leading end 19*b* positioned between a premix burner 15*r* and a premix burner 15*s*. Other configurations are the same as those in the first embodiment.

At a time of ignition using the gas fuel, the gas fuel is supplied to a diffusion burner 14 and three premix burners 15*u*, 15*w*, and 15*y* of the combustor 3*a* as in the first embodiment. In the second embodiment, because the leading end 19*a* of the ignition plug 18*a* is disposed on the premix burner 15*u* as viewed from the combustion chamber 10, sparking the ignition plug 18*a* enables smooth ignition of the combustor 3*a*. Following the ignition of the combustor 3*a*, all the other combustors are ignited through the same operations as in the first embodiment.

At a time of ignition using the liquid fuel, the liquid fuel is supplied to the diffusion burner 14 of the combustor 3*b* as in the first embodiment. In the second embodiment, because the leading end 19*b* of the ignition plug 18*b* is disposed between the premix burner 15*r* and the premix burner 15*s* as viewed from the combustion chamber 10, the mixture jetted out from the diffusion burner 14 travels through an air stream jetted out from the premix burner 15*r* and the premix burner 15*s* to reach the leading end 19*b* of the ignition plug 18*b*. Sparking the ignition plug 18*b* thus causes the combustor 3*b* to be smoothly ignited. Following the ignition of the combustor 3*b*, all the other combustors are ignited through the same operations as in the first embodiment.

Through the foregoing arrangements, the combustors (3*a*, 3*b* . . . ) according to the second embodiment, because including the cross fire tubes 20, achieve effects similar to those achieved by the first embodiment. In addition, the second embodiment achieves the following effects.

In the second embodiment, the ignition plug 18*a* is disposed in the combustor 3*a* so as to have the leading end 19*a* positioned on the premix burner 15*u* as viewed from the combustion chamber 10 and the ignition plug 18*b* is disposed in the combustor 3*b* so as to have the leading end 19*b* positioned between the premix burner 15*r* and the premix burner 15*s*. For these reasons, when the gas fuel is supplied to the premix burner 15*w* as described above, for example, the ignition using the ignition plug 18*a* allows the ignition performance to be further improved. When the liquid fuel is supplied to the diffusion burner 14, the ignition using the ignition plug 18*b* allows the ignition performance to be further improved. Consequently, regardless of whether either the gas fuel or the liquid fuel is used or both the gas fuel and the liquid fuel are used, the ignition performance is further improved for higher reliability.

Miscellaneous

It should be noted that the present invention is not limited to the above-described embodiments and may include various modifications. For example, the entire detailed arrangement of the embodiments described above for ease of understanding of the present invention is not always necessary to embody the present invention. Part of the arrangement of one embodiment may be replaced with the arrangement of another embodiment, or the arrangement of one embodiment may be combined with the arrangement of another embodiment. The arrangement of each embodiment may additionally include another arrangement, or part of the arrangement may be deleted or replaced with another.

Each of the above-described embodiments has been exemplarily described for a case in which six premix burners 15 are disposed around the diffusion burner 14. The essential effect of the present invention is to provide a highly reliable combustor capable of ignition and flame propagation at low fuel concentrations regardless of whether a gas fuel, a liquid fuel, or both are used. No specific quantity is fixed for the premix burners 15 as long as this essential effect will be achieved. For example, six or more premix burners 15 may be disposed around the diffusion burner 14.

Each of the above-described embodiments has been exemplarily described as including the ten combustors (3*a*, 3*b* . . . ) disposed annularly along the outer circumferential portion of the casing of the turbine 2. Nonetheless, no specific quantity is fixed for the combustors as long as this essential effect will be achieved. For example, ten or more combustors may be disposed along the outer circumferential portion of the casing of the turbine 2.

What is claimed is:

1. A plurality of combustors disposed annularly along an outer peripheral portion of a casing of a turbine, each of the combustors respectively comprising:

a combustion chamber that burns fuel and air to thereby generate a combustion gas;

a diffusion burner disposed upstream of the combustion chamber;

a liquid fuel system that supplies liquid fuel to the diffusion burner;

a plurality of premix burners disposed around the diffusion burner;

a plurality of cross fire tubes configured to communicate between the combustion chamber and respective combustion chambers of the combustors adjacent to the combustion chamber in a circumferential direction of the casing; and a gas fuel system that supplies gas fuel to a first premix burner, of the plurality of premix burners, and the diffusion burner, located at an axial center of the combustion chamber, wherein a central axis of a first cross fire tube, of the plurality of cross fire tubes, is aligned with a straight line that passes through the axial center of the combustion chamber and an axial center of the first premix burner, wherein the first cross fire tube is connected to one of the plurality of combustors adjacent to a first side of the combustion chamber in the circumferential direction of the casing, and wherein a second cross fire tube, of the plurality of cross fire tubes, is connected to another one of the plurality of combustors adjacent to a second side of the combustion chamber in the circumferential direction of the casing, a central axis of the second cross fire tube passes through the axial center of the combustion chamber and between a second premix burner and a third premix burner, of the plurality of premix burners, which are adjacent to each other and closest to the second cross fire tube, wherein the diffusion burner is further disposed on the extension of the central axis of the second cross fire tube, wherein at a time of ignition using the gas fuel, the gas fuel is supplied by the gas fuel system, and wherein at a time of ignition using the liquid fuel, the liquid fuel is supplied by the liquid fuel system.

2. The combustors according to claim 1, further comprising:

a first ignition plug disposed to have a leading end arranged on one of the plurality of premix burners; and a second ignition plug disposed to have a leading end arranged between adjacent ones of the plurality of premix burners.

3. The combustors according to claim 2, wherein the plurality of premix burners consist of six premix burners disposed around the diffusion burner.

4. A gas turbine plant comprising:

the plurality of combustors according to claim 1;

a compressor that supplies compressed air to the plurality of combustors; and a turbine driven by a combustion gas supplied from the plurality of combustors.

5. The combustors according to claim 1, wherein a first straight line and a second straight line pass through the axial center of the combustion chamber and are tangent to respective inner wall surfaces of the first premix burner, wherein an angle formed between the first line and the second line is less than or equal to 30°.

* * * * *